US006311615B1

(12) United States Patent
Hilliard

(10) Patent No.: US 6,311,615 B1
(45) **Date of Patent: *Nov. 6, 2001**

(54) COMPOSITE NIP ROLL AND NIP RING

(75) Inventor: Michael William Hilliard, Somersworth, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/114,904

(22) Filed: Jul. 14, 1998

(51) Int. Cl.[7] ..... B41F 5/04
(52) U.S. Cl. ..... 101/212; 101/219
(58) Field of Search ..... 101/212, 232, 101/216, 219, 228; 492/47, 48, 39, 30

(56) References Cited

U.S. PATENT DOCUMENTS

| | | | | |
|---|---|---|---|---|
| 1,711,148 | * | 4/1929 | Hult | 101/232 |
| 3,599,306 | * | 8/1971 | Brafford | 492/30 |
| 3,685,443 | * | 8/1972 | Kusters | 101/219 |
| 3,883,293 | * | 5/1975 | McCarroll | 492/47 |
| 3,990,391 | * | 11/1976 | Singh | 492/47 |
| 4,864,343 | * | 9/1989 | Nelson | 354/304 |
| 4,961,378 | * | 10/1990 | Balow et al. | 101/228 |
| 4,974,782 | * | 12/1990 | Nelson | 492/39 |
| 5,553,806 | * | 9/1996 | Lucas | 492/48 |
| 5,576,803 | * | 11/1996 | Williams et al. | 492/47 |
| 5,842,962 | * | 12/1998 | Yamada et al. | 492/18 |

FOREIGN PATENT DOCUMENTS 0 743 183A3 11/1996 (EP) .

OTHER PUBLICATIONS

Western Roller Corp., Split Nip System, Newspapers & Technology, Mar. 1998 p. 21.

* cited by examiner

*Primary Examiner*—John S. Hilten
*Assistant Examiner*—Anthony H. Nguyen
(74) *Attorney, Agent, or Firm*—Burns, Doane, Swecker & Mathis, LLP

(57) ABSTRACT

A composite nip roll or nip ring that is durable and requires minimal adjustment, and which accurately provides a constant gain. In accordance with an exemplary embodiment, the nip roll or ring has a rigid shaft, a resilient polymer inner material mounted on the rigid shaft, and a metal outer covering over the resilient polymer inner material. The metal covering can be rigid or flexible. The nip roll can also include limiting rings that limit deflection of the outer covering to a maximum amount.

25 Claims, 9 Drawing Sheets

COMPOSITE NIP ROLL AND NIP RING

BACKGROUND OF THE INVENTION

1. Field of the Invention

The present invention relates generally to rolls for use in a printing press. More particularly, the present invention relates to rolls and rings used in nips in a printing press.

2. State of the Art

Those skilled in the art will recognize that the press shown in FIG. 7 is an exemplar of a conventional web-fed printing press that can be configured differently in accordance with techniques and principles well known in the art. For example, the press 700 can be configured to have multiple print units 720, multiple infeed units 710, multiple folder units 750, depending on the application. In addition, the dryer unit 730 and the chill unit 740 can be omitted. Although only one dryer unit 730 and one chill unit 740 are shown, a conventional web-fed printing press can include multiple dryer units and/or multiple chill units.

In conventional web-fed printing presses, such as the press of FIG. 7, nips contact ribbons or webs of print media moving through the printing press and are often used to control and/or stabilize the webs. Nips can be used in many areas of the printing press. For example, nips can be used in the infeed unit 710, the chill unit 740, and the folder unit 750 of the printing press.

A nip is a device that catches or squeezes an object between two surfaces, points, or edges. Printing press nips typically include two cylinders positioned close together, so that the two cylinders simultaneously contact and squeeze or grip the web as it passes between them. FIG. 8 shows a side view of a nip 800 including nip cylinders 812 and 814, and a web 810 passing between the cylinders 812 and 814. If one of the nip cylinders has a diameter that varies along the rotational axis of the cylinder, then the other cylinder can have cooperating variations in diameter. Alternatively, the other cylinder can have a substantially constant diameter along its rotational axis. The web 810 need not form a straight line as it passes through the nip 800. Each of the nip cylinders 812 and 814 can be, for example, a nip roll or a nip ring. Rolls typically provide full contact along the entire width of the ribbon. Rings can also be used, and are typically movable along a shaft so they can be adjusted for different web widths, printing situations, and the like. Nip rings provide partial contact along the width of the ribbon, often near the ends of the ribbon width. Typically, at least one of the cylinders in a nip is driven. Often, one of the nip cylinders is a driven steel roll, and the other is a polymer-covered idler roll.

In particular, nip rolls and nip rings can perform multiple functions that enhance performance of the printing press. For example, they can grip the ribbons, and thus regulate both speed and tension of the ribbons as the ribbons move through the printing press. The ribbon is typically stretched during the cutting process, so that when the ribbon is cut the release of tension in the ribbon causes the cut ends to snap away from the cut point. A special kind of nip roll called an anti-snap-back (ASB) roll can be used to grip the ribbon near the cut point and thus reduce snap distances of the cut ribbon ends.

ASB rolls can also be used to corrugate a ribbon or web along the ribbon's direction of travel through the printing press, thereby providing a stiffened free end when the ribbon is cut. The increased stiffness of the cut end allows the cut end to be guided with greater precision between stages within the press. Nip rolls and/or nip rings can also be used to help set and reinforce a fold or crease in a ribbon when the ribbon passes through a nip. Typically, nip rings and ASB rolls are located within the folder unit.

Although nips that use solid steel nip rolls and/or knurled steel nip rings are typically durable and long-wearing, their performance is sensitive to the setting and adjustment of a roll-to-roll gap between the nip rolls and/or nip rings, particularly when a small number of ribbons are run through the press. Efforts have been made to redesign the roll-to-roll gap mechanism to offer better mechanical advantage and to increase the precision of the roll gap setting, but the resulting mechanisms only marginally maintain the roll-to-roll gap when the printing press is running.

Since the early 1960's, rigid nip rolls and nip rings having a thin, external layer of polymer have been incorporated into some web-fed printing presses. These rolls and rings are less sensitive to roll-to-roll gap settings than the solid steel rolls and rings, but exhibit greater wear over time. In addition, although the polymer covering is flexible, it is also incompressible. This can result in an undesirable gain in velocity of the ribbon as it moves between the rolls or through the nip, for example when the roll-to-roll gap is narrow. The gain typically increases with a magnitude of deflection or displacement of the polymer.

Other roll configurations have been disclosed, as for example in European Patent Application EP 0 743 183 A2.

It would be desirable to provide nip rolls and nip rings that are more durable than the polymer covered nip rolls and nip rings and provide constant gain independent of deflection, and that require less precise and frequent adjustment than the solid steel nip rolls and nip rings.

SUMMARY OF THE INVENTION

The present invention is directed to low-maintenance nip cylinders, e.g., nip rolls and nip rings, that are durable and require minimal adjustment, and which accurately provide desired gains that are constant and independent of deflection. In accordance with an exemplary embodiment, a nip roll is provided which has a rigid shaft, a resilient inner material mounted on the rigid shaft, and a flexible outer covering over the resilient inner material. The outer covering has a tensile strength that is greater than a tensile strength of the resilient inner material. The outer covering can be made of a metal, and the resilient inner material can be made of a polymer. In accordance with another exemplary embodiment, the outer covering is rigid. The nip roll can optionally include limiting rings between the rigid shaft and an inner surface of the outer covering, to limit deflection of the outer covering and polymer to a maximum amount. This maximum amount can vary in accordance with desired design characteristics and performance parameters, and on the particular application.

BRIEF DESCRIPTION OF THE DRAWINGS

Other objects and advantages of the present invention will become apparent to those skilled in the art from the following detailed description of preferred embodiments, when read in conjunction with the accompanying drawings. Like elements have been designated with like reference numerals.

DETAILED DESCRIPTION OF THE PREFERRED EMBODIMENTS

Figure 1:
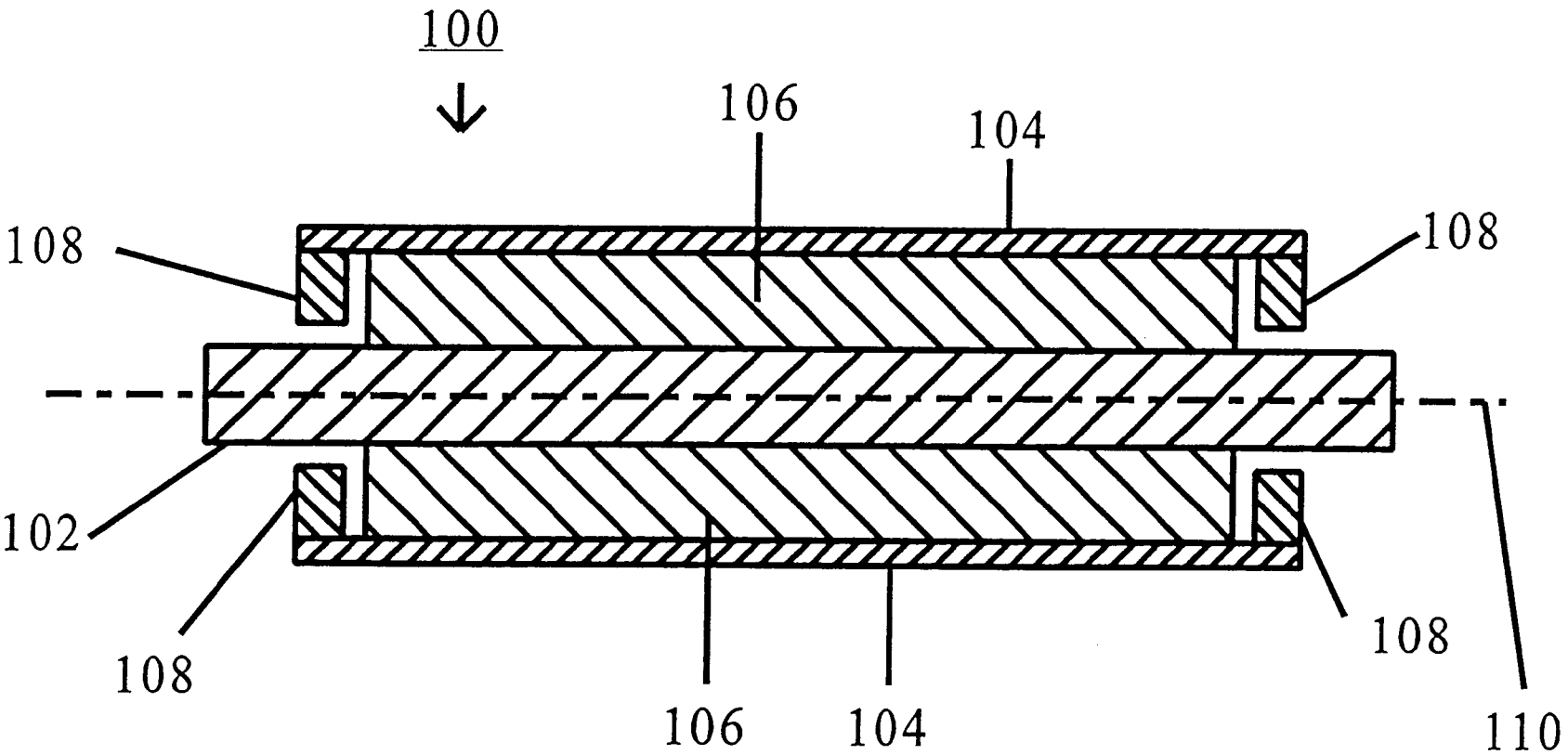
FIG. 1 is a cross-sectional view of a nip roll in accordance with an embodiment of the invention.

FIG. 1 shows a cross-sectional view of a nip roll 100 in accordance with a first embodiment of the invention. The roll 100 rotates about a rotational axis 110, and includes a shaft 102, a polymer inner material 106 surrounding the shaft 102 and a flexible outer covering 104 surrounding the polymer inner material 106. The flexible outer covering 104 will bend in response to a local force applied to its exterior, for example by a ribbon passing between the roll 100 and another roll or nip ring. The outer covering 104 can be made of any material that is suitably flexible and durable. For example, the outer covering 104 can be made of a metal such as steel, or any other suitably durable material that has a tensile strength greater than that of the polymer inner material 106. The polymer inner material 106 can be made of polyurethane, silicone, or any other resilient material having a suitable density, modulus of elasticity, and other properties. These properties can include, for example, rebound characteristics, coefficient of heat transfer, melting point, and amount of frictional heat generated for a given deflection and rotational speed. The polymer inner material 106 is preferably made of a resilient material that is incompressible, such as solid polyurethane, but can also be made of a resilient material that is compressible. For example, a resilient material can be provided with closed cells filled with a gas, or with open cells.

As explained above, the outer surface of the outer covering 104 contacts a ribbon that is moving through the printing press, and a force exerted by the ribbon on the outer covering 104 causes the outer covering 104 to deflect and flatten at the contact area. Limiting rings 108 contact an inner diameter of the outer covering 104 at the ends of the outer covering 104, but have a gap between an inner circumference of the limiting ring 108 and the shaft 102. Thus, when the outer covering 104 and the inner material 106 deflect sufficiently, a portion of the inner diameter of the limiting ring 108 will contact the shaft 108 and limit or prevent further deflection. Alternatively, as shown for example in FIG. 4, limiting rings 408 can be provided that ride on the shaft 102, and have an outer diameter that is smaller than an inner diameter of the outer covering 404. Thus, when an outer covering 404 and the inner material 106 are sufficiently deflected, the limiting rings 408 will contact a portion of an inner surface of the outer covering 404 and limit or prevent further deflection. The limiting rings 108 and 408 can be made of suitably rigid and durable materials such as steel. The limiting rings can also be omitted completely from the nip roll.

Figure 9:
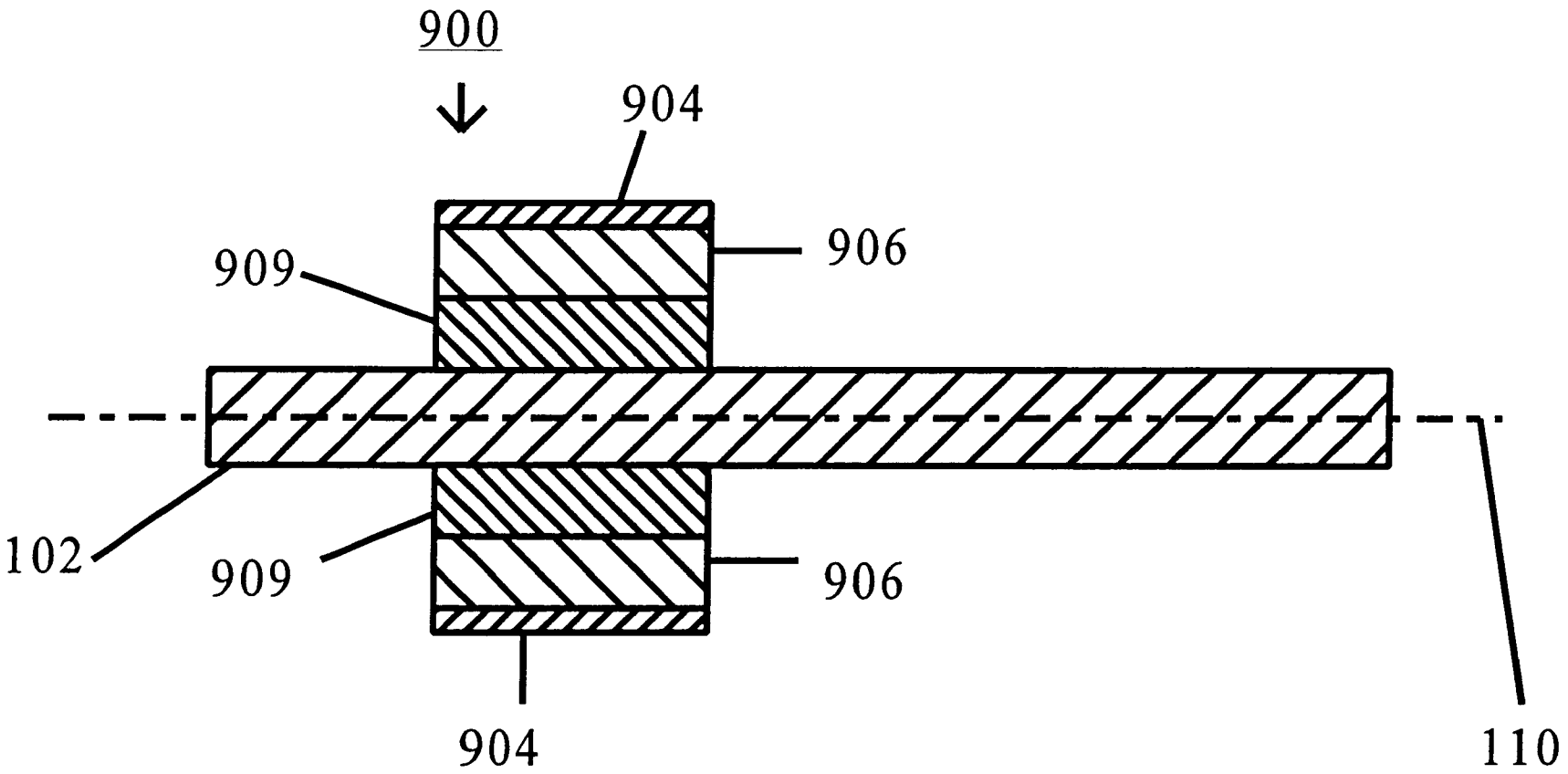
FIG. 9 is a cross-sectional view of a nip ring in accordance with an embodiment of the invention.

FIG. 9 shows a nip ring 900 having a resilient polymer inner material 906 that is similar to the inner material 106, and a flexible outer covering 904 that is similar to the outer covering 104. The ring 900 performs similarly to the rolls 100, 200, 300 and 400 described above, but extends across only part of a web passing through the nip. The ring 900 is also movable along the axis 110 of the shaft 102. An inner ring 909 is provided between the shaft 102 and the inner material 906, to allow the nip ring 900 to be moved along the shaft 102. The inner ring 909 can be, for example, a split ring made of metal that can tightened in accordance with techniques well known in the art to fix the nip ring 900 at a particular location along the shaft 102, and loosened when the nip ring 900 is to be moved to a different location.

Figure 2:
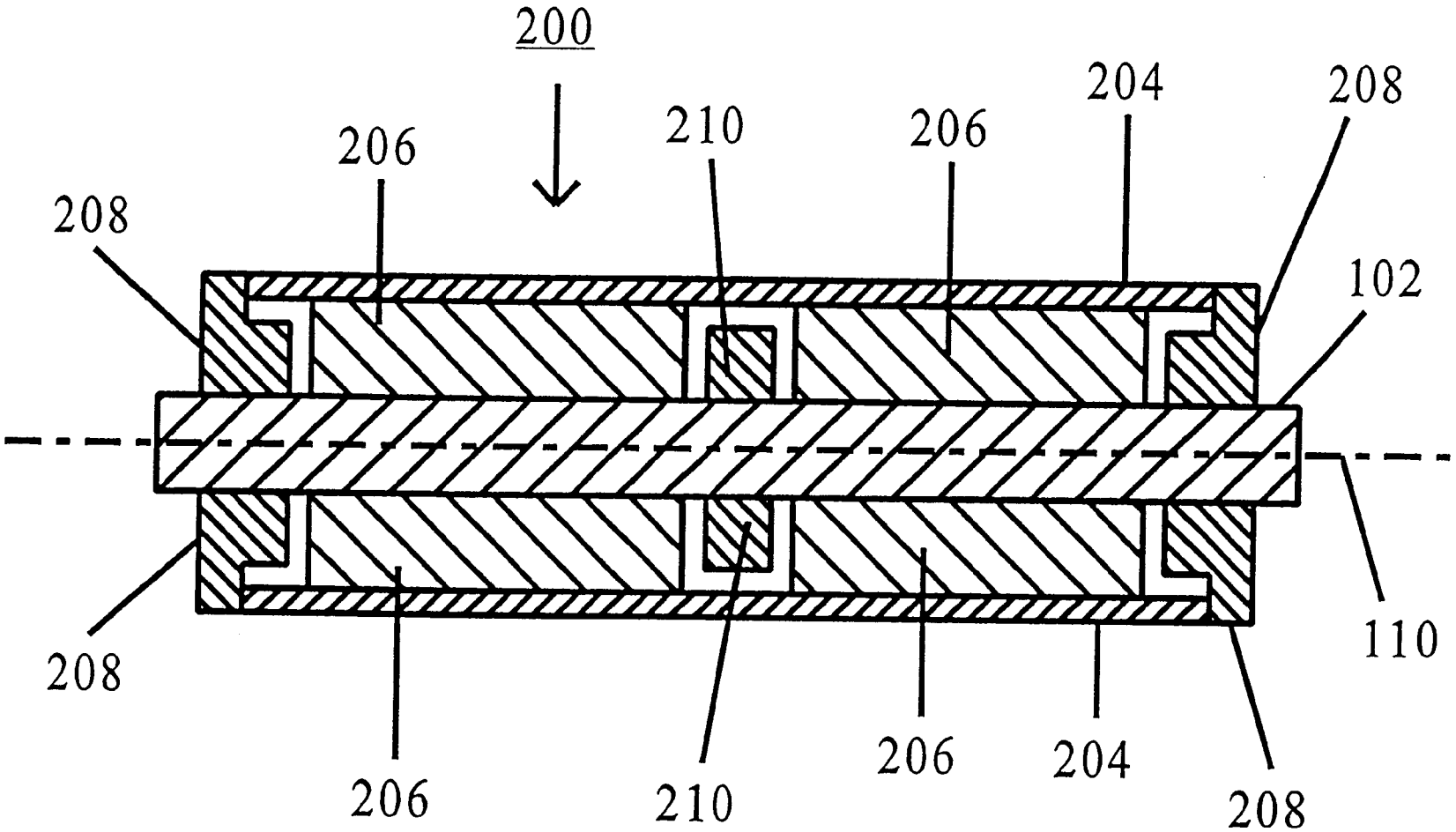
FIG. 2 is a cross-sectional view of a nip roll in accordance with an embodiment of the invention.
Figure 3:
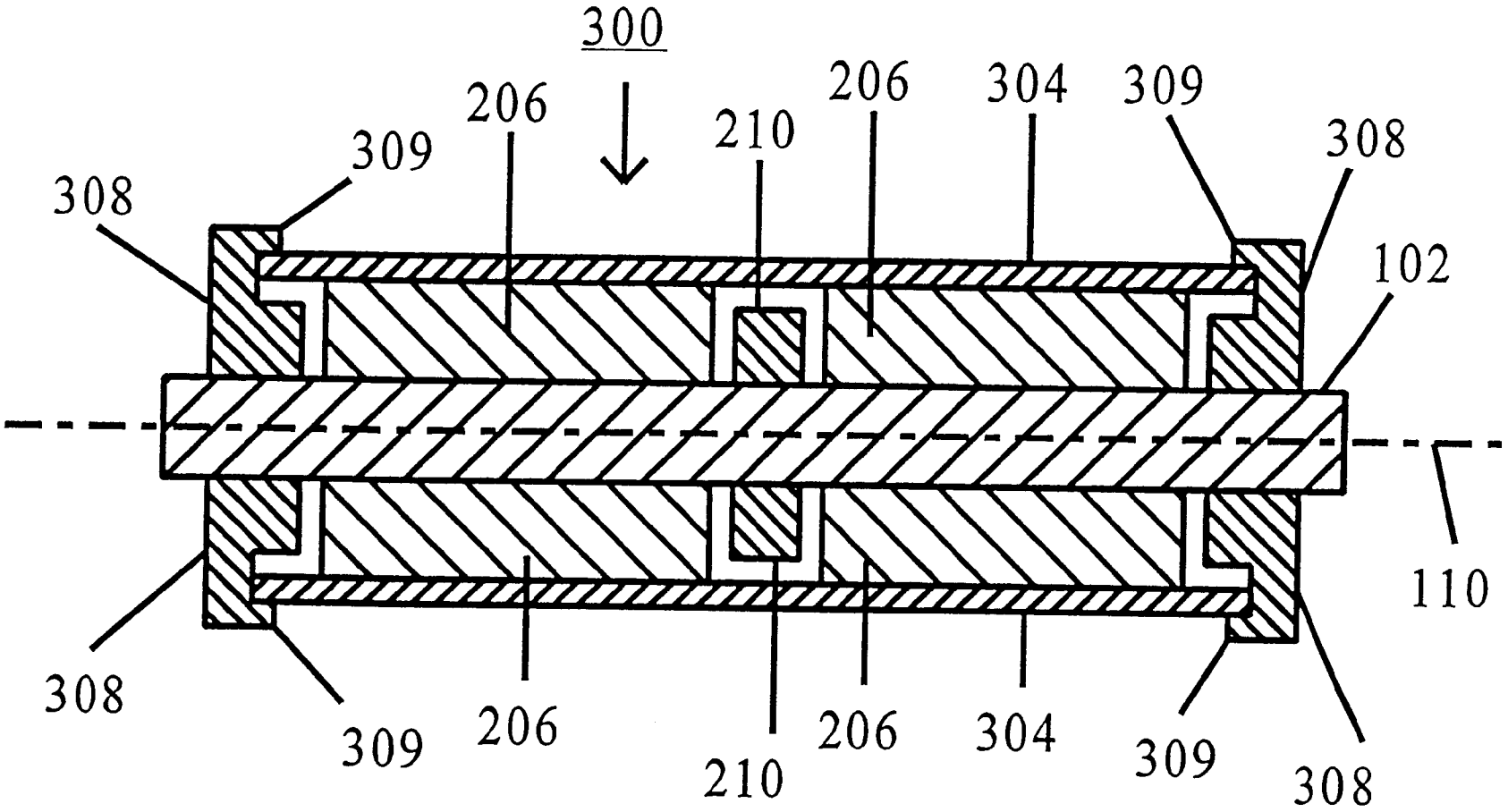
FIG. 3 is a cross-sectional view of a nip roll in accordance with an embodiment of the invention.

FIGS. 2 and 3 show nip rolls 200, 300 including limiting rings 208, 308. The limiting rings 208, 308 function similarly to the limiting rings 408 of FIG. 4. The rings 208 also limit movement of the outer cover 206 along the axis 110. The rings 308 are similar to the rings 208, but also include rims 309 that enclose an outer edge of the outer covering 304. Thus, the rings 308 limit movement of the outer cover 306 along the axis 110, as well as limiting a maximum deflection of the outer cover 306 away from the shaft 102. The limiting rings 210 function similarly to the limiting rings 408 of FIG. 4.

Figure 4:
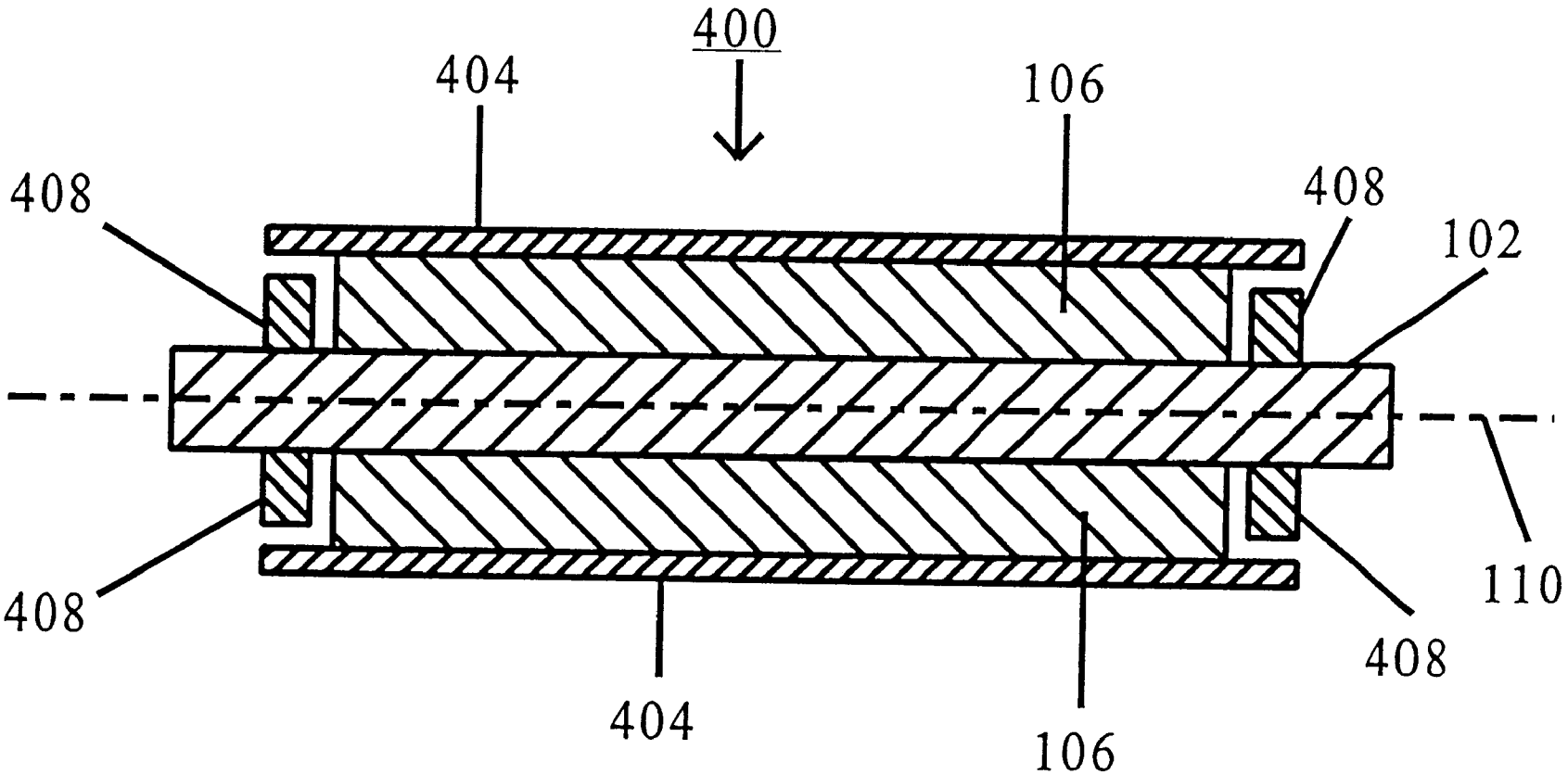
FIG. 4 is a cross-sectional view of a nip roll in accordance with an embodiment of the invention.

As with the outer covering 104 shown in FIG. 1 and described above, the outer coverings 204, 304 and 404 shown in FIGS. 2–4 can be flexible, and made for example of spring steel, nickel, nylon or other suitable material. The flexible outer coverings have sufficient tensile strength to contain the polymer inner materials and thus provide constant gain, particularly where the polymer is incompressible, and are sufficiently durable. Alternatively, the outer coverings 204 and 404 can be rigid, and made for example of nickel, steel, or other suitable material having sufficient hardness and thickness to effectively resist bending when used in the printing press. When the outer coverings 204 and 404 are rigid, then the entire outer covering is displaced with respect to the rotational axis 110 in response to a force applied by a ribbon and/or another roll or nip ring.

Although the limiting rings have been described above as being rigid, they can be flexible. Thus, properties of the limiting rings can be selected to further refine the deflection response curve of the roll and match it to particular applications of the invention. For example, the limiting rings can be components separate from the shaft, or can be integrally machined portions of the shaft. The limiting rings can also be omitted completely.

According to an embodiment of the invention, the roll 400 shown in FIG. 4 can be configured so that an outer diameter of the outer covering 404 is 6.400 inches, a thickness of the outer covering 404 is 0.005 inches, the outer covering 404 is made of nickel and the polymer inner material 106 is made of polyurethane. In this configuration a 0.020 inch deflection of the outer covering 404 and polymer inner material 106 in a radial direction toward the rotational axis 110 will result in a ribbon contact surface that describes a chord 0.714 inches long across the original circumference of the outer covering 404. A 0.004 inch deflection of the outer covering 404 and polymer inner material 106 in a radial direction toward the rotational axis 110 will result in a ribbon contact surface that describes a chord 0.319 inches long. According to an embodiment of the invention, for a non-slip nip ring design using these dimensions and materials, a minimal radial deflection of the outer covering 104 and polymer inner material 106 can be approximately 0.010 inches. These dimensions and materials are exemplary, and can be modified depending on desired performance parameters and application. For example, different materials can be used, and the dimensions can be made greater or lesser, to provide similar performance with the different materials, or enhanced performance in different situations.

Figure 5:
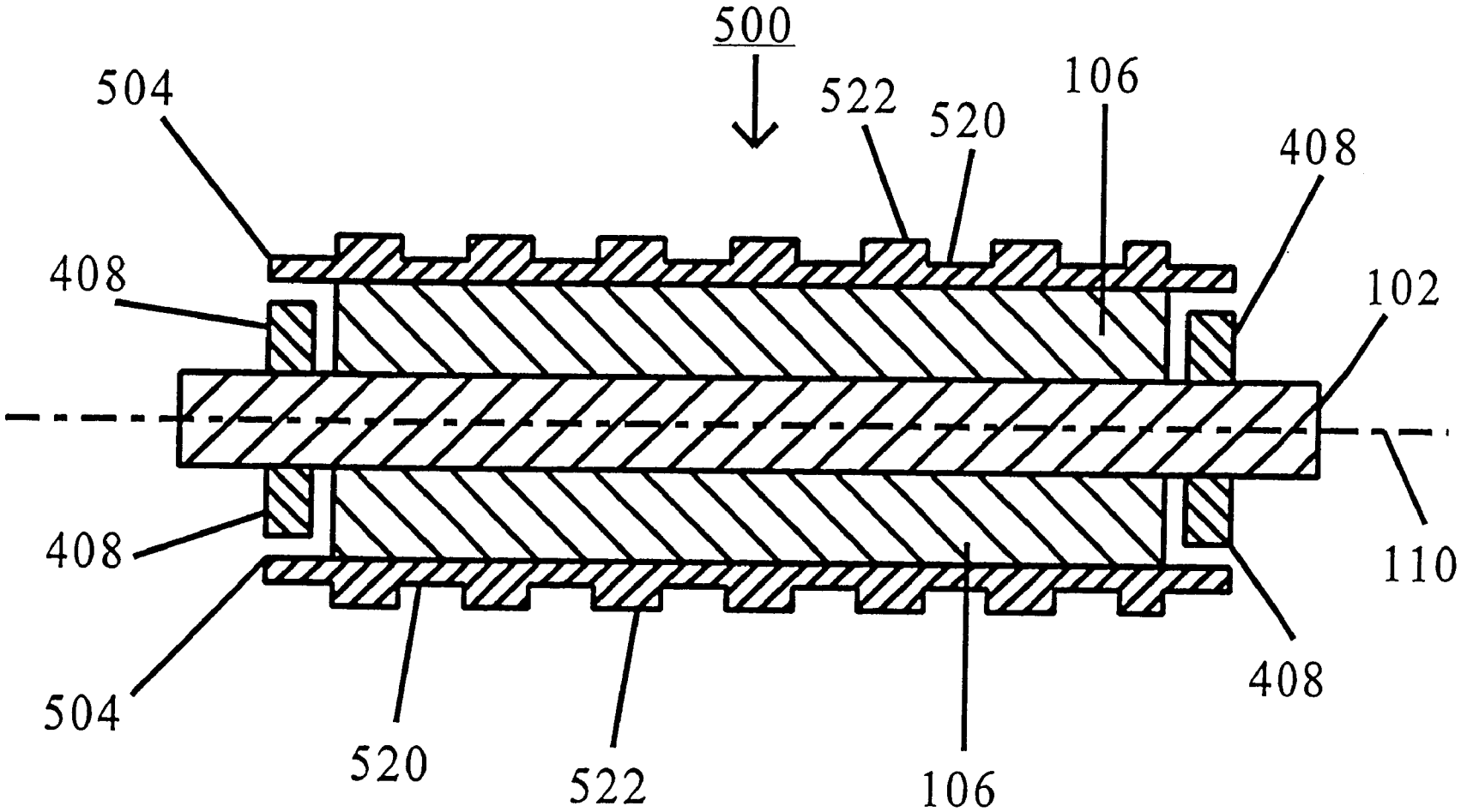
FIG. 5 is a cross-sectional view of a nip roll in accordance with an embodiment of the invention.

FIG. 5 shows a roll 500 according to another embodiment of the invention, which differs from the embodiment shown in FIG. 4 in that a rigid steel outer covering 504 is provided with integral recesses 520 and protrusions 522 that corrugate a ribbon (not shown) passing over the roll 500.

Figure 6:
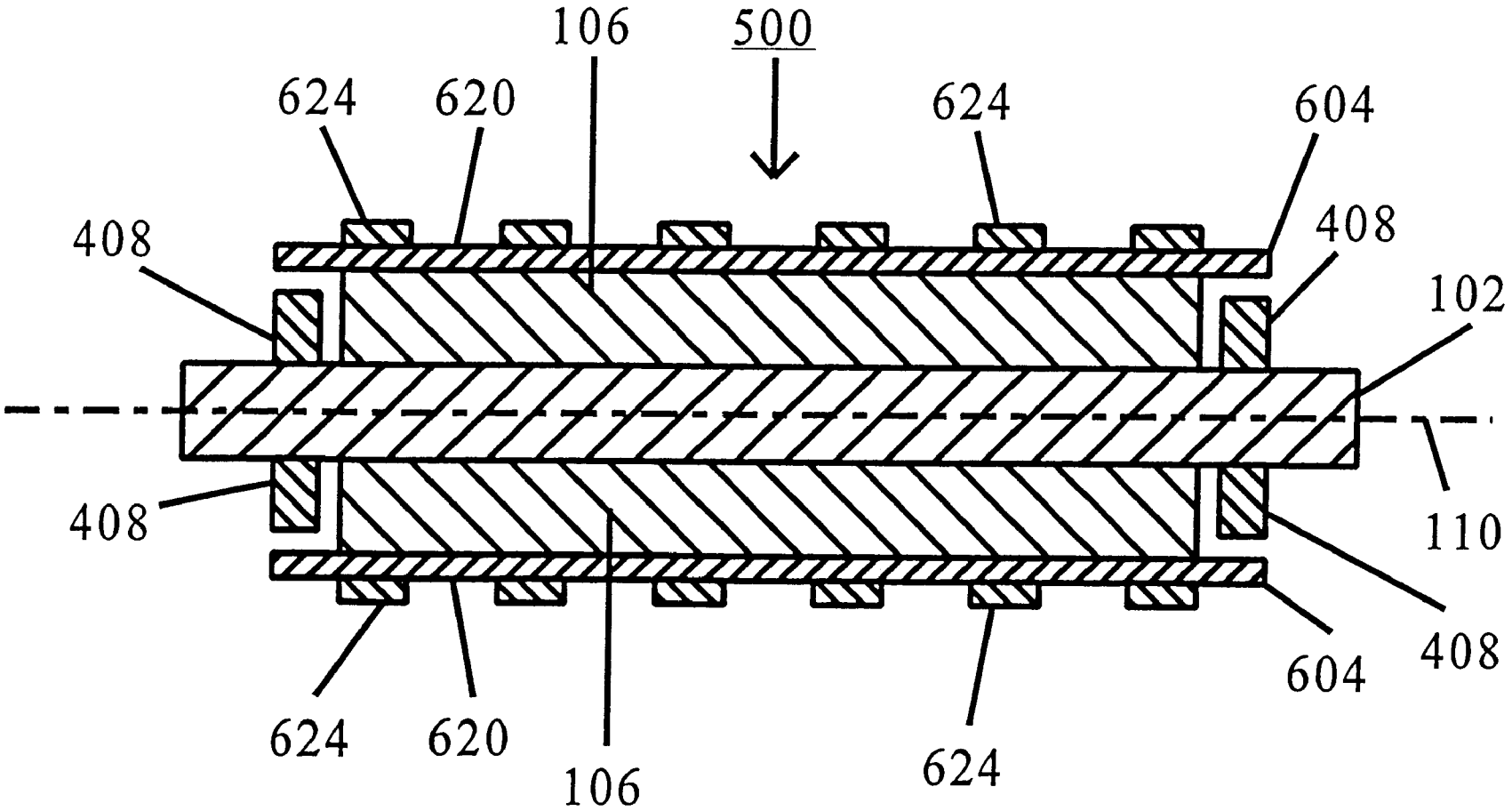
FIG. 6 is a cross-sectional view of a nip roll in accordance with an embodiment of the invention.
Figure 7:
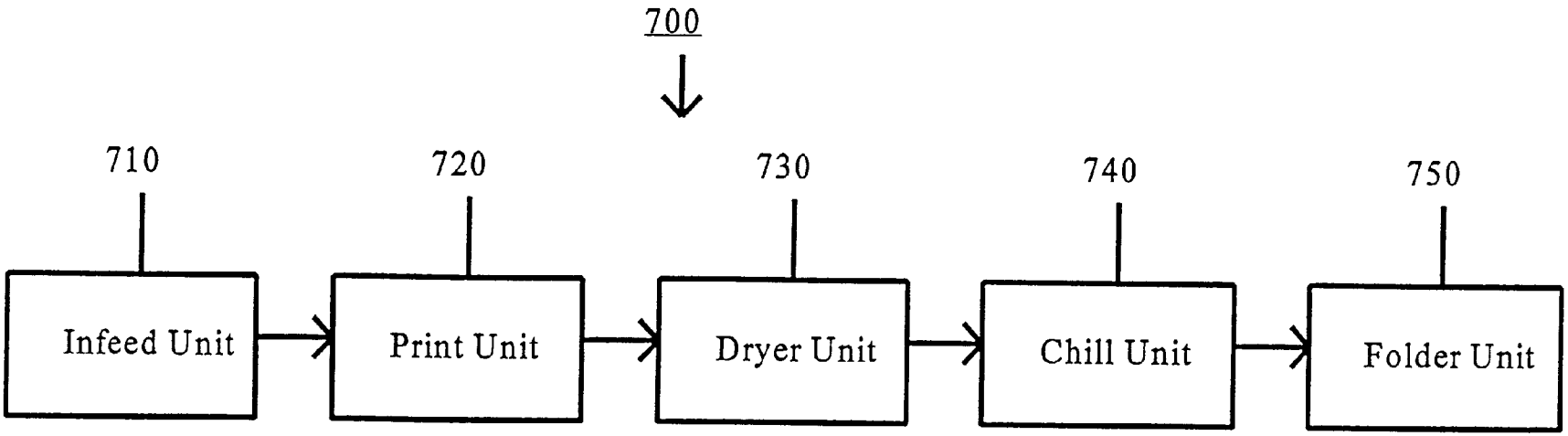
Prior Art Fig. 7
FIG. 7 is a block diagram of a printing press which can include the invention.
Figure 8:
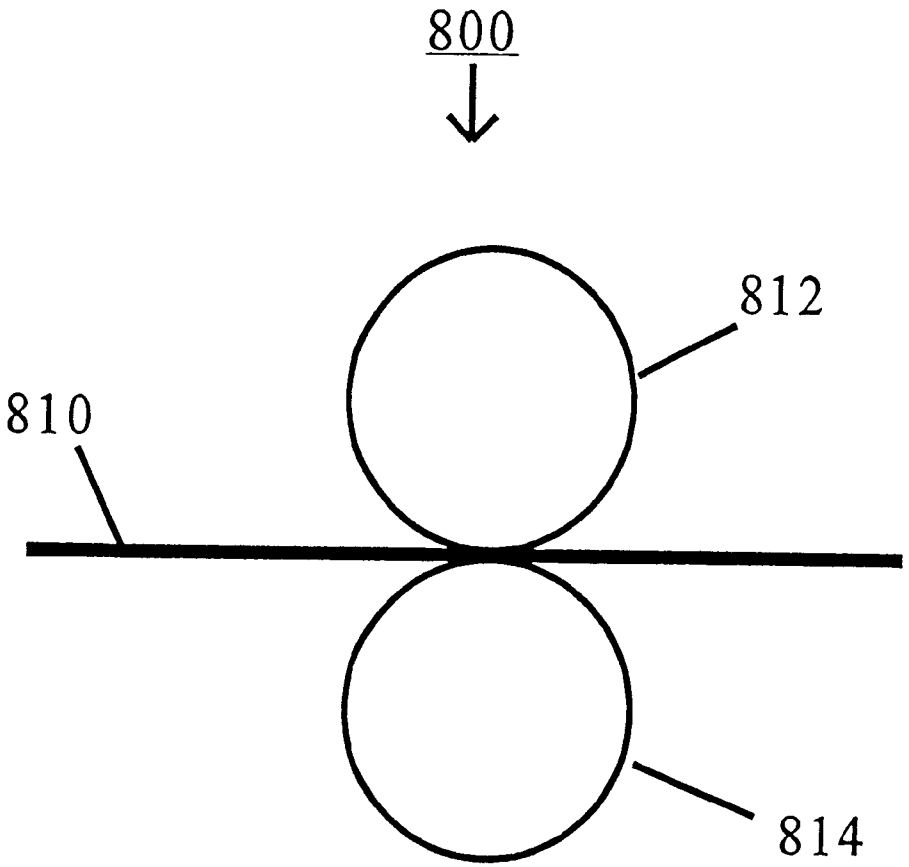
FIG. 8 is a side view of a web passing through a nip which can incorporate an embodiment of the invention.

Alternatively, as shown in the roll 600 of FIG. 6, recesses 620 and protrusions can be provided on a flexible outer covering 604 by wrapping the outer covering 604 with rings 624 that form protrusions. Each ring 624 can, for example, be made of a material such as Velcro™ or a metal. The rings 624 can be configured by design and choice of material to be either flexible or rigid, can be used on either a rigid outer covering or a flexible outer covering, and can be movable along the axis 110 of the roll 600.

In summary, composite nip rolls and nip rings constructed in accordance with the invention provide advantages including the durability and constant gain of solid steel nip rolls and nip rings, and the decreased sensitivity to variations in roll-to-roll gap dimensions of polymer-coated nip rolls and nip rings.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A web-fed rotary printing press, comprising:

a cylinder forming a nip roll or a nip ring, the cylinder having a rigid shaft;

a polymer inner material around the shaft;

an outer covering around the polymer inner material; and at least one limiting ring between the shaft and the outer covering, wherein the at least one limiting ring limits further deflection of the polymer inner material and the outer covering when the polymer inner material and the outer covering are deflected by a predetermined amount.

2. The cylinder of claim 1, wherein an inner diameter of the at least one limiting ring is greater than an outer diameter of the shaft, and an outer diameter of the at least one limiting ring matches an inner diameter of the outer covering.

3. The cylinder of claim 2, wherein a difference between the inner diameter of the at least one limiting ring and the outer diameter of the shaft is greater than about 0.020 inches.

4. The cylinder of claim 1, wherein the outer covering comprises metal.

5. The cylinder of claim 1, wherein the outer covering comprises nylon.

6. The cylinder of claim 1, wherein the outer covering comprises a material having a greater tensile strength than the polymer inner material.

7. The cylinder of claim 1, wherein the outer covering comprises a material having a greater hardness than the polymer inner material.

8. The roll of claim 1, wherein the cylinder is movable along a rotational axis of the shaft.

9. The roll of claim 1, wherein the limiting ring is rigid.

10. The roll of claim 1, wherein the polymer inner material is incompressible.

11. The roll of claim 1, wherein the outer covering is rigid.

12. The roll of claim 1, wherein the outer covering is flexible.

13. The roll of claim 1, wherein the polymer inner material consists of at least one of polyurethane and silicone.

14. The cylinder of claim 1, wherein an inner diameter of the at least one limiting ring matches an outer diameter of the shaft, and an outer diameter of the at least one limiting ring is less than an inner diameter of the outer covering.

15. The cylinder of claim 14, wherein at least one of the at least one limiting ring has a flange extending radially from a rotational axis of the cylinder past an end of the outer covering.

16. The cylinder of claim 15, wherein the at least one of the at least one limiting rings has a rim on the flange enclosing an outer edge of the outer covering.

17. The cylinder of claim 14, wherein a difference between the outer diameter of the at least one limiting ring and the inner diameter of the outer covering is greater than about 0.020 inches.

18. A web-fed rotary printing press, comprising:

a first cylinder forming a nip roll or a nip ring, the first cylinder having a rigid shaft;

a polymer inner material around the shaft;

a rigid outer covering around the polymer inner material; and at least one limiting ring between the rigid shaft and the rigid outer covering;

wherein when a force is applied to the first cylinder by a ribbon or a second cylinder, the entire rigid outer covering is displaced with respect to a rotational axis of the first cylinder, and wherein the at least one limiting ring limits further deflection of the polymer inner material and the outer covering when the polymer inner material and the outer covering are deflected by a predetermined amount.

19. A web-fed rotary printing press, comprising:

a first cylinder; and a second cylinder; wherein the first and second cylinders form a nip, and at least one of the first and second cylinders comprises a rigid shaft, a polymer inner material around the shaft, an outer covering around the polymer inner material, and at least one limiting ring between the rigid shaft and the outer covering;

wherein the at least one limiting ring limits further deflection of the polymer inner material and the outer covering when the polymer inner material and the outer covering are deflected by a predetermined amount.

20. The press of claim 19, wherein at least one of the first and second cylinders has a diameter that varies along a rotational axis of the at least one roll.

21. The press of claim 19, wherein each of the first and second cylinders has a diameter that varies along a rotational axis of the cylinder, and the varying diameter of one of the first and second cylinders cooperates with the varying diameter of the other of the first and second cylinders.

22. The roll of claim 19, wherein the outer covering comprises a material having a greater tensile strength than the polymer inner material.

23. A web-fed rotary printing press, comprising:

a cylinder forming a nip roll or a nip ring, the cylinder having a rigid shaft;

a resilient inner material around the shaft;

an outer covering around the resilient inner material; and at least one limiting ring between the shaft and the outer covering;

wherein the outer covering has a greater tensile strength than the resilient inner material, and wherein the at least one limiting ring limits further deflection of the resilient inner material and the outer covering when the resilient inner material and the outer covering are deflected by a predetermined amount.

24. The cylinder of claim 23, wherein the resilient inner material is incompressible.

25. The cylinder of claim 23, wherein the resilient inner material is compressible.

* * * * *